United States Patent [19]

Kitawaki

[11] Patent Number: 4,741,367

[45] Date of Patent: May 3, 1988

[54] HEALD FRAME FOR LOOMS

[75] Inventor: Kazuya Kitawaki, Osaka, Japan

[73] Assignee: Nankai Kogyo Kabushiki Kaisha, Osaka, Japan

[21] Appl. No.: 41,734

[22] Filed: Apr. 22, 1987

[30] Foreign Application Priority Data

Apr. 22, 1986 [JP] Japan ..... 61-60347[U]

[51] Int. Cl.[4] ..... D03C 9/06

[52] U.S. Cl. ..... 139/91

[58] Field of Search ..... 139/91, 92

[56] References Cited

FOREIGN PATENT DOCUMENTS 224575 4/1962 Austria ..... 139/91
446221 10/1967 Switzerland ..... 139/91
759632 8/1980 U.S.S.R. ..... 139/91
1051143 10/1983 U.S.S.R. ..... 139/91

*Primary Examiner*—Henry S. Jaudon
*Attorney, Agent, or Firm*—Browdy and Neimark

[57] ABSTRACT

A heald frame formed in a square configuration by joining a pair of frame staves forming the top and bottom frame members and a pair of side stays forming the right and left frame members has generally four flexibly constructed joint joints of the frame staves and side stay to prevent breakage which may result during the operation on a high-speed loom. A projection at the end of the side stay is disposed interiorly with a spacer mounted thereto within the hollow frame stave and then secured with the spacer which is depressed inwardly so as to have a deformed shape, whereby the projection of the side stay and the inner wall of the frame stave will be securely joined by the spacer.

5 Claims, 3 Drawing Sheets

HEALD FRAME FOR LOOMS

FIELD OF THE INVENTION

The present invention relates generally to an improved heald frame (termed also a heddle frame) which is utilized in a loom to provide the vertically reciprocating movements of thread of warp and, more particularly, to a heald frame comprising a pair of frame staves forming the top and bottom frame members and a pair of side stays forming the right and left frame members, and having at least four joints of the frame staves and side stays which are improved in structure to provide strength and thus to prevent breakage.

BACKGROUND OF THE INVENTION

A heald frame has generally a square configuration formed by joining the frame staves and side stays at their respective ends. The heald frame includes also a pair of carrier rods which are vertically spaced out so that a multiplicity of healds can be secured at both ends thereto. Each of said healds accepts a warp thread passing therethrough. The heald frame is provided in a loom so as to reciprocate vertically. The heald frame is intended to travel at a higher rate of speed in a recently introduced high-speed loom and hence will bear a force of momentum in motion. Accordingly, the momentum causes deflection on each of the top and bottom frame staves which will thus be bowed inwardly and outwardly during the movements. Consequently, the deflection produces an intensive moment of bend at the joint between the frame stave and the side stay. The joint section of generally rigid construction in which the frame staves and side stays are fastened tightly can barely endure the moment of bend exerted thereon and breakage may result.

The problem of breakage is even more serious when the heald frame is provided with openings therethrough. Particularly, a heald frame of fiber reinforced plastic (RFP) reinforced with glass or carbon fibers becomes weakened when holes are provided in the frame, and this occurs because of the cutting of the fibers to provide openings in the frame. Under these circumstances, breakage is even more likely to result when the heald frame is subjected to a considerable moment of bend.

SUMMARY OF THE INVENTION

It is an object of the present invention to provide a heald frame in which the joint section of a frame stave and a side stay is movably and flexibly constructed so as to provide distortion upon being subjected to great strain and thus is able to absorb the moment of bend exerted thereon in order to prevent breakage.

It is another object of the present invention to provide a heald frame in which the joint section of the frame stave and a side stay is detachably constructed in such a way that the heald frame can be easily assembled and disassembled.

It is a further object of the present invention to provide a heald frame which is prevented from reducing strength by eliminating or minimizing the need for providing openings therein. Particularly, a heald frame of fiber reinforced plastic (RFP) employing glass fiber or carbon fiber according to the invention is stronger because no openings need be provided therein.

It is a still further object of the present invention to provide a heald frame in which a projection provided on the end of the side stay and a hollow of the frame stave are flexibly joined by a resilient spacer that is mounted to the projection disposed interiorly within the hollow of the frame stave and remains depressed inwardly to have a deformed shape.

Other features and advantages of the present invention will become apparent from the following description taken in conjunction with the accompanying drawings, wherein:

DESCRIPTION OF PREFERRED EMBODIMENTS

Figure 1:
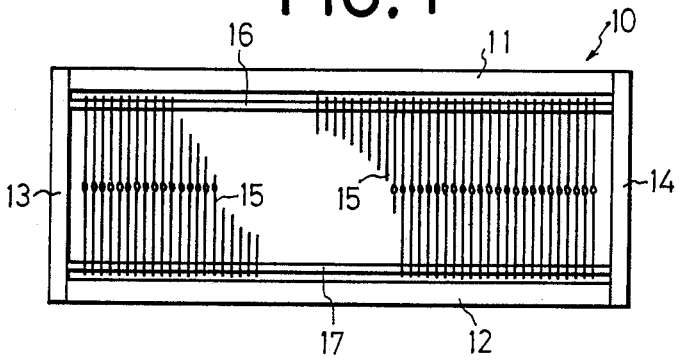
FIG. 1 is a front view of an embodiment of a heald frame according to the present invention.

FIG. 1 illustrates a heald frame generally according to the present invention. The heald frame 10 comprises a pair of frame staves 11 and 12 forming the top and bottom frame members and a pair of side stays 13 and 14 forming the right and left frame members. Said frame staves 11, 12 and side stays 13, 14 are joined at their respective ends to form a square configuration. A multiplicity of healds 15 are mounted to the heald frame in such a way that the opposite ends of the healds 15 are secured respectively to a pair of equally spaced carrier rods 16 and 17.

Figure 2:
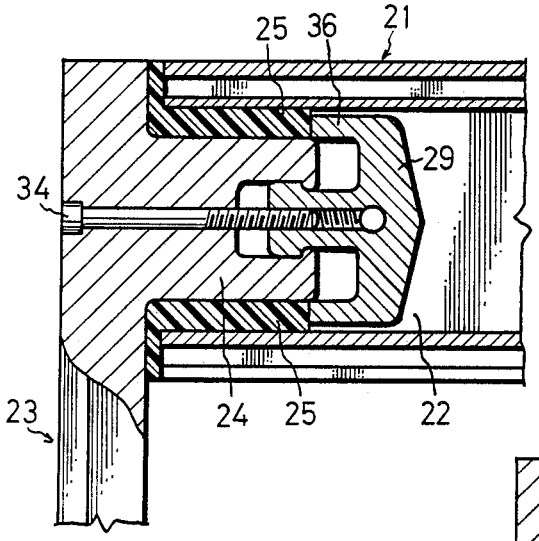
FIG. 2 is a cross sectional assembly view of a joint section of the frame stave and side stay, illustrating one preferred embodiment of a heald frame of the present invention.
Figure 3:
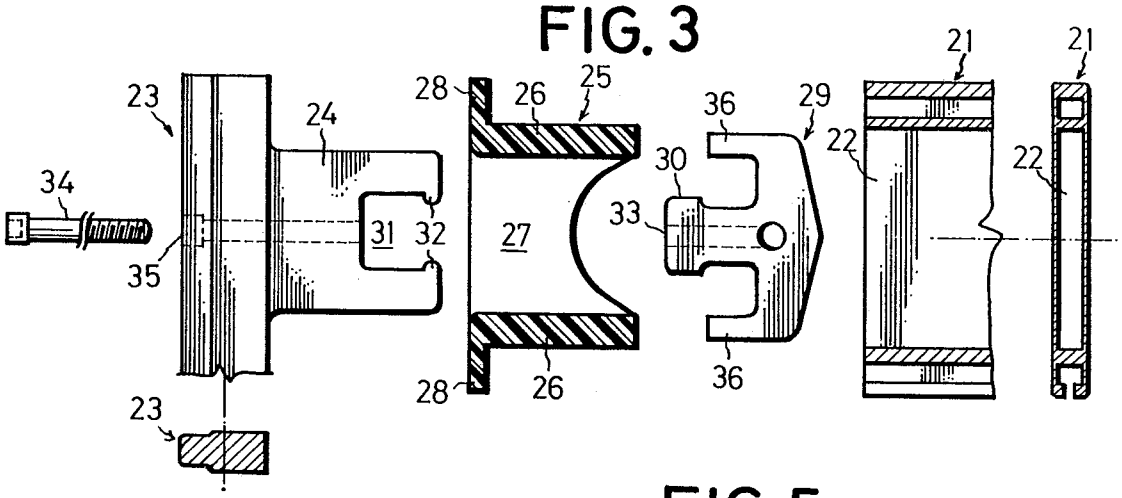
FIG. 3 is an exploded front view, partially in cross section, similar to FIG. 2.

FIGS. 2 and 3 show one embodiment of the joint section by which the frame stave and side stay are joined. Shown is one of the four joints which are identical in structure. A frame stave 21 in this embodiment has a hollow 22 interiorly as shown in FIG. 3. A side stay 23 shown has at least a projection 24 on the side wall at an end, the projection 24 being integral with the body of the side stay 23. A spacer 25, made of resilient material such as rubber, flexible synthetic resin, or the like, is placed over the projection 24. The spacer 25 includes upper and lower wall portions 26 having a relatively greater thickness to provide rigidity. The spacer 25 includes also side wall portions 27 having a thickness so as to provide support between the upper and lower wall sections 26. A flange 28 is integrally formed on the end of the spacer 25. The flange 28 is disposed between the contacting surfaces of the frame stave 21 and side stay 23 so as to provide a cushioning effect.

A retaining member 29 is movably mounted to the forward end of the projection 24 in a joint relationship. More specifically, a boss portion 30 in the center of the retaining member 29 is accepted within a notched portion 31 of the projection 24. The notched portion 31 is cut deeper than the length of the boss portion 30 so that the boss portion 30 can be moved axially by a distance of the difference between the lengths of the boss portion 30 and the notch 31. A pair of small projections, which act as stops to prevent removal of the boss 30, are formed at the end of the notched portion 31. The boss portion 30 can be inserted into the notch 31 from the side of the same.

The boss portion 30 has an internally threaded screw bore 33 therein to accept a screw or bolt 34. The bolt 34 is disposed through the side stay 23 and its projection 24. The side stay 23 has a bore 35 across the projection 24 to accept the bolt 34. Accordingly, the axial position of the retaining member 29 can be changed by rotating the bolt 34. Because both arms 36 of the retaining member 29 communicate at their end with the spacer 25, when the bolt 34 rotates for tightening, the spacer 25 is pressed with the arms 36 and will be continuously advanced in an axial lengthwise direction until the walls 26 thereof expand outwardly in a thickness direction, i.e. becomes thicker.

More specifically, the projection 24 with the spacer 25 and the retaining member 29 thereon is placed interiorly within the hollow 22 of the frame stave 21 with the bolt 34 remaining loosened to provide no pressure on the spacer 25. Upon tightening the bolt 34 the spacer 25 expands in a thicknesswise direction to press against the inner surface of the frame stave 21 and the surface of the projection 24 and thus provide the frictional force needed to prevent removal of the projection 24 from the hollow 22. A moment of bend at the joint resulting from the deflection on the frame stave 21 during the weaving operation on the loom will be absorbed by means of elastic deformation of the spacer 25.

Figure 4:
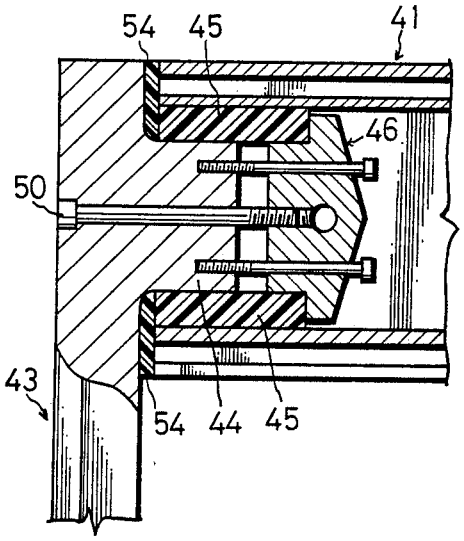
FIG. 4 is a cross sectional assembly view of a joint section of a heald frame, illustrating another embodiment of the present invention.
Figure 5:
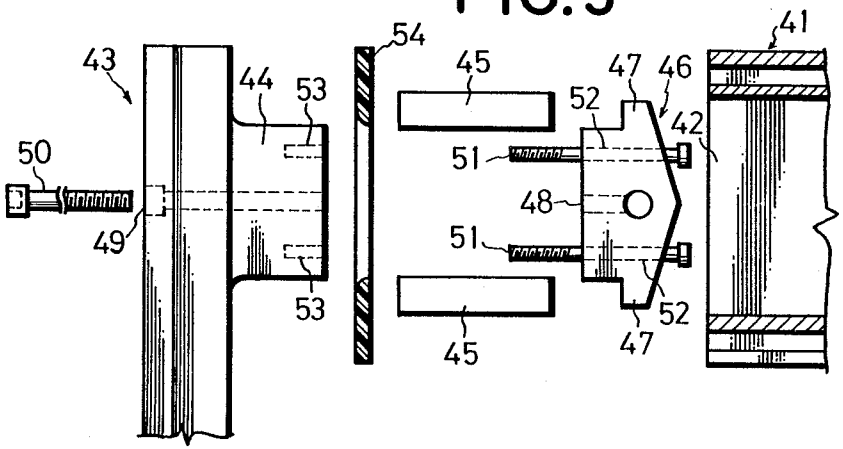
FIG. 5 is an exploded front view, partially in cross section, similar to FIG. 4.

FIGS. 4 and 5 illustrate another embodiment of the joint section. As arranged similar to the aforesaid embodiment, a frame stave 41 has a hollow 42 therein and a side stay 43 includes at least a projection 44. A pair of upper and lower spacers 45 of flexible resilient material are provided separately. The spacers 45 are pressed respectively at their ends with both the arms 47 of a retaining member 46. The remaining member 46 has an integrally threaded screw bore 48 to accept a threaded bolt 50 extended through the side stay 43 and its projection 44. A pair of bolts 51 to prevent removal of the retaining member 46 from the projection 44 are movably disposed within bores 52 of the retaining member 46 and accepted respectively at their ends in screw bores 53 formed in the projection 44. Accordingly, the retaining member 46 can be moved within a distance equal to the length of the bolt 51.

The spacers 45 and retaining member 46 are mounted to the projection 44 so as to be placed interiorly within the hollow 42 of the frame stave 41 as shown in FIG. 4. After insertion, the spacers 45 can be deformed by tightening the bolts 51 so as to press against the inner wall of the frame stave 41 for joining. The principles and functions of joining are the same as shown in FIG. 2. A cushioning member 54 is closely disposed between the end of frame stave 41 and the side stay 43.

In the two embodiments (FIGS. 2 and 5) set forth above, it is unnecessary to have openings or bores in the frame staves. Accordingly, a frame stave formed of FRP (fiber reinforced plastic) can provide strength without the need for cutting out openings for connecting the stays and staves. Furthermore, in the embodiments a tension resulting from the restoring force of the spacer is continuously exerted counterwisely on the bolts screwed thus to prevent them from loosening.

Figure 6:
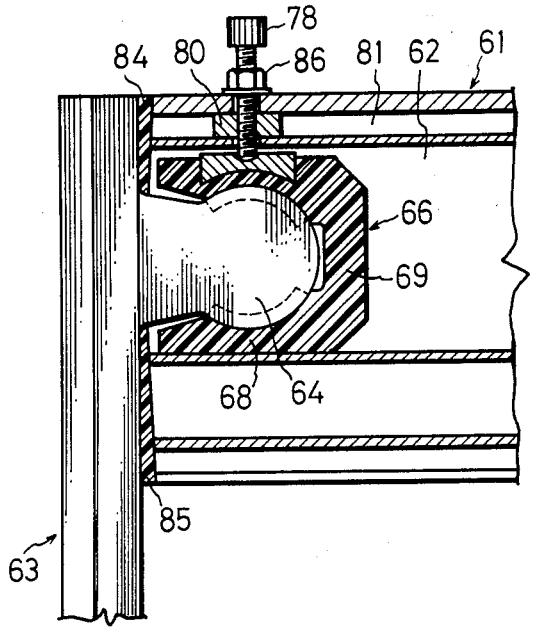
FIG. 6 is a cross sectional assembly view of a joint section of the heald frame, illustrating a further embodiment of the present invention.
Figure 7:
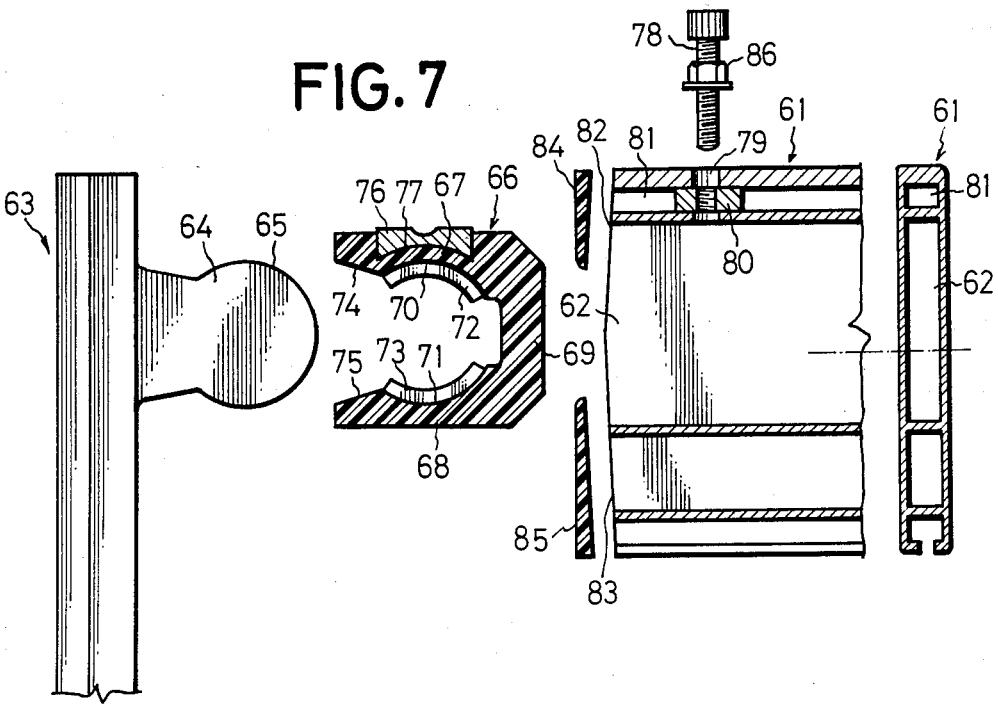
FIG. 7 is an exploded front view, partially in cross section, similar to FIG. 6.

FIGS. 6 and 7 illustrate a further embodiment of the present invention. A frame stave 61 has a hollow 62 therein and a side stay 63 includes at least a projection 64. The projection 64 has at its forward end a round shaped portion 65. A generally U-shaped spacer 66 having an interior which is roughly complementary to the exterior shape of the projection 64 is harder in quality than the same shown in FIGS. 2 and 4. The spacer 66 comprises an upper portion 67, a lower portion 68, and a connecting portion 69 and hence will hold the projection 64 with the upper and lower leg portions 67, 68. Accordingly, the interior surfaces 70 and 71 of the respective upper and lower portions 67, 68 are arranged in a concave configuration. Collar portions 72 and 73 to prevent the projection 64 from moving laterally are extended from the interior surfaces 70 and 71 at both sides. Entrance portions 74 and 75 of the respective interior surfaces 70 and 71 are tapered out towards the outside so that the projection 64 can be pivoted to a certain degree with the spacer 66 fitted thereover.

A retaining member 76 is halfway embedded in the upper exterior surface of the spacer 66. The bottom 77 of the retaining member 76 is formed on the concave configuration so as to exert pressure equally along the interior surface 70. Against the retaining member 76 a bolt 78 exerts pressure downwardly on the upper leg 67 of the U-shaped spacer 66. The bolt 78 is disposed through a bore 79 in the top wall of the frame stave 61 so as to press with its bottom against the retaining member 66. A rectangular shaped nut 80 screwed onto bolt 78 is disposed interiorly within another hollow 81 of the frame stave 61. The nut 80 is prevented by the wall at the hollow 81 from rotating. The frame stave 61 has tapered edges 82 and 83 at the end so as to accept resilient cushioning members 84 and 85 respectively.

According to this embodiment, the projection 64 of the side stay 64 is inserted with the spacer 66 fitted thereover into the hollow 62 of the frame stave 61. The bolt 78 is screwed through the bore 79 into the nut 80 and is rotated in a tightening direction until the bottom of the bolt 78 touches the top of the retaining member 76. When the bolt 78 has been tightened, pressure by the bolt 78 will be transmitted via the retaining member 76 to the spacer 66 of which the upper leg portion 67 thus presses against the projection 65 and, at the same time, the lower leg portion 68 presses with its bottom surface against the inner wall of the hollow 62. With the bolt 78 tightened the spacer 66 holds the projection 65 by pressing from the upper and lower sides while the bottom of the spacer 66 remains depressed against the inner wall at the hollow 62, whereby the projection 65 will be prevented from removal outwardly. While tightened, the bolt 78 is secured by tightening the nut 86 screwed previously onto the bolt 78 and thus will be prevented from loosening.

According to the embodiment illustrated in FIGS. 6 and 7, the connecting surfaces of the projection 64 and spacer 66 are arranged in the arc shaped configuration so that the projection 64 can be pivoted a small amount about the spacer 66. Accordingly, a moment of bend exerted at the joint between the frame stave 61 and the side stay 64 during the operation on the loom will be absorbed by the relative slide movements on the curved connecting surfaces. Additionally, according to the embodiment, the moment of bend will be absorbed by the elastic deformation of the spacer 66 in the same manner as the other embodiments set forth above. More specifically, according to this embodiment, the moment of bend will be absorbed by the combined performance of the slide movements on the curved surfaces and the elastic deformation of the spacer 66.

While the preferred embodiments have been described in accordance with the present invention, it will be understood that the scope of the invention is not limited to the described embodiments and changes can be made without departing from the scope of the invention.

What is claimed is:

1. A heald frame for looms, comprising:

a pair of frame staves having hollow ends;

a pair of side stays each having projections at their ends for joining each of said projections with a spacer mounter thereto for disposal interiorly together with a retaining member within a hollow end of the frame stave;

a plurality of resilient spacers each disposed on and substantially surrounding a said projection respectively, each spacer having a resting shape wherein it is insertable into said hollow end, and a deformed shape;

a cushioning member positioned between an edge of each said frame stave hollow end and a respective side stay;

a retaining member directly connected to each spacer, the retaining member being pressed against the spacer to provide said deformed shape of said spacer; and means for exerting pressure upon each retaining member thus to depress the spacer and provide said deformed shape to hold the projection securely and, at the same time, remain depressed intensively against the inner wall at the hollow end.

2. A heald frame for looms as defined in claim 1, in which the retaining member is axially movably mounted to the outward end of the projection so as to advance towards the side stay with the use of a pulling means extended through the side stay and its projection, whereby the spacer located between the projection and the inner wall of the frame stave, upon being pressed with arms of the retaining member, becomes laterally expanded to prevent the projection from removing outwardly and thus provide a flexible joint.

3. A heald frame for looms as defined in claim 1, in which the retaining member includes a boss portion which is movably accepted within a notch arranged in the outward end of the projection and also has a screw bore to accept a bolt extended through the side stay and its projection.

4. A heald frame for looms as defined in claim 1, in which the retaining member is movably associated with a plurality of bolts provided on the outward end of the projection and also has at the boss portion thereof a screw bore to accept the bolt extended through the side stay and its projection.

5. A heald frame for looms, comprising:

a pair of hollow frame staves;

a pair of side stays each having projections at their ends for joining each of said projections with a spacer mounter thereto for disposal interiorly together with a retaining member within a hollow of the frame stave;

a plurality of resilient spacers each disposed on a said projection respectively, each spacer having a resting shape wherein it is insertable into said hollow, and a deformed shape;

a retaining member directly connected to each spacer, the retaining member being pressed against the spacer to provide said deformed shape of said spacer; and means for exerting pressure upon each retaining member thus to depress the spacer and provide said deformed shape to hold the projection securely and, at the same time, remain depressed intensively against the inner wall at the hollow;

in which the projection is round shaped at its end while the inside of the spacer is arranged in the concave configuration so that the projection and spacer are communicated at a curved joint, the spacer remaining depressed by a pressing means extended through the frame stave.

* * * * *